US006439771B1

(12) United States Patent
Herrington, Jr.

(10) Patent No.: US 6,439,771 B1
(45) Date of Patent: Aug. 27, 2002

(54) ZIPPERED RESEALABLE CLOSURE

(75) Inventor: F. John Herrington, Jr., Bloomfield, NY (US)

(73) Assignee: Webster Industries Division Chelsea Industries, Inc., Peabody, MA (US)

( * ) Notice: Subject to any disclaimer, the term of this patent is extended or adjusted under 35 U.S.C. 154(b) by 0 days.

(21) Appl. No.: 09/592,327

(22) Filed: Jun. 13, 2000

Related U.S. Application Data

(60) Provisional application No. 60/189,518, filed on Mar. 15, 2000.

(51) Int. Cl.[7] ..... B65D 33/24; A44B 19/00

(52) U.S. Cl. ..... 383/64; 383/65; 24/399; 24/400; 24/587

(58) Field of Search ..... 383/63, 64, 65; 24/399, 400, 587

(56) References Cited

U.S. PATENT DOCUMENTS

| | | | | |
|---|---|---|---|---|
| 3,054,434 A | * | 9/1962 | Ausnit et al. | 383/65 |
| 3,115,689 A | | 12/1963 | Jacobs | |
| 3,122,807 A | * | 3/1964 | Ausnit | 383/64 X |
| 3,173,184 A | * | 3/1965 | Ausnit | 383/64 X |
| 3,202,559 A | | 8/1965 | Laguerre | |
| 3,259,951 A | | 7/1966 | Zimmerman | |
| 3,324,520 A | | 6/1967 | Ausnit | |
| 3,426,396 A | | 2/1969 | Laguerre | |
| 3,591,914 A | | 7/1971 | Heinberger | |
| 3,713,923 A | | 1/1973 | Laguerre | |
| 3,784,432 A | | 1/1974 | Noguchi | |
| 3,787,269 A | | 1/1974 | Noguchi | |
| 3,790,992 A | * | 2/1974 | Herz | 383/64 X |
| 3,904,468 A | | 9/1975 | Noguchi | |
| 3,959,425 A | | 5/1976 | Herrington | |
| 3,959,856 A | * | 6/1976 | Ausnit | 383/64 X |
| 3,976,732 A | | 8/1976 | Herrington | |
| 4,022,558 A | | 5/1977 | Herrington | |
| 4,046,408 A | | 9/1977 | Ausnit | |
| 4,069,292 A | | 1/1978 | Herrington | |
| 4,081,231 A | | 3/1978 | Herrington | |
| 4,101,355 A | | 7/1978 | Ausnit | |
| 4,118,453 A | | 10/1978 | Herrington | |
| 4,154,563 A | | 5/1979 | Johnson | |
| 4,170,450 A | | 10/1979 | Herrington, Jr. | |
| 4,174,932 A | | 11/1979 | Herrington | |
| 4,209,475 A | | 6/1980 | Herrington et al. | |
| 4,212,337 A | | 7/1980 | Kamp | |
| 4,215,597 A | | 8/1980 | Miller et al. | |
| 4,219,516 A | | 8/1980 | Herrington, Jr. | |
| 4,234,018 A | | 11/1980 | Herrington, Jr. | |
| 4,268,239 A | | 5/1981 | Herrington, Jr. | |
| 4,285,656 A | | 8/1981 | Herrington | |
| 4,289,727 A | | 9/1981 | Herrington, Jr. | |
| 4,341,575 A | | 7/1982 | Herz | |
| 4,344,907 A | | 8/1982 | Herrington | |

(List continued on next page.)

OTHER PUBLICATIONS

PCT Partial International Search Report Invitation to Pay Additional Fees PCT/US 01/08394 Date of Mailing Sep. 6, 2001.

*Primary Examiner*—Jes F. Pascua
(74) *Attorney, Agent, or Firm*—Bromberg & Sunstein LLP

(57) ABSTRACT

A zipper profile for a fastener assembly is provided. The profile includes a male element and a female element. The female element has a pair of jaws that are movable with respect to one another about a common fulcrum region, and a pair of arms each of which are coupled to a corresponding one of the pair of jaws at the fulcrum region. Each of the arms has an end opposite from the fulcrum region that is shaped for engagement with a slider, and the jaws have an open position and a closed position. The arms are disposed to cause movement of the jaws between the closed position and the open position when the arms experience displacement about the fulcrum region. Displacement about the fulcrum region may be effectuated by motion of a slider relative to the arms. The male element is captured by the female element when the jaws are in the closed position and released when the jaws are in the open position.

32 Claims, 8 Drawing Sheets

U.S. PATENT DOCUMENTS

| | | | | |
|---|---|---|---|---|
| 4,354,541 | A | | 10/1982 | Tilman |
| 4,372,792 | A | | 2/1983 | Dey et al. |
| 4,384,942 | A | | 5/1983 | Glowacki |
| 4,392,897 | A | | 7/1983 | Herrington |
| 4,395,221 | A | | 7/1983 | Herrington |
| 4,410,130 | A | | 10/1983 | Herrington |
| 4,419,087 | A | | 12/1983 | Herrington |
| 4,419,159 | A | | 12/1983 | Herrington |
| 4,421,465 | A | | 12/1983 | Herrington |
| 4,430,070 | A | | 2/1984 | Ausnit |
| 4,443,400 | A | | 4/1984 | Herrington |
| 4,472,923 | A | | 9/1984 | Herrington |
| 4,479,244 | A | | 10/1984 | Ausnit |
| 4,487,597 | A | | 12/1984 | Herrington |
| 4,512,476 | A | | 4/1985 | Herrington, Jr. |
| 4,513,559 | A | | 4/1985 | Herrington, Jr. |
| 4,516,268 | A | | 5/1985 | Kamp |
| 4,519,146 | A | | 5/1985 | Herrington |
| 4,528,244 | A | | 7/1985 | Winkelbauer et al. |
| 4,532,652 | A | | 7/1985 | Herrington |
| 4,541,117 | A | | 9/1985 | Ashbeck |
| 4,553,370 | A | | 11/1985 | Anderson et al. |
| 4,561,109 | A | | 12/1985 | Herrington |
| 4,570,411 | A | | 2/1986 | Herrington |
| 4,578,813 | A | | 3/1986 | Ausnit |
| 4,581,006 | A | | 4/1986 | Hugues et al. |
| 4,584,820 | A | | 4/1986 | Herrington |
| 4,601,694 | A | | 7/1986 | Ausnit |
| 4,603,434 | A | | 7/1986 | Herrington |
| 4,618,383 | A | | 10/1986 | Herrington |
| 4,619,021 | A | | 10/1986 | Johnson |
| 4,619,638 | A | | 10/1986 | Herrington |
| 4,620,320 | A | | 10/1986 | Sullivan |
| 4,623,323 | A | | 11/1986 | Herrington |
| 4,628,536 | A | | 12/1986 | Herrington |
| 4,628,665 | A | | 12/1986 | Herrington |
| 4,637,063 | A | | 1/1987 | Sullivan et al. |
| 4,640,640 | A | | 2/1987 | Herrington |
| 4,650,451 | A | | 3/1987 | Herrington |
| 4,654,021 | A | | 3/1987 | Herrington |
| 4,654,180 | A | | 3/1987 | Herrington |
| 4,656,900 | A | | 4/1987 | Herrington |
| 4,660,259 | A | | 4/1987 | Ausnit |
| 4,660,874 | A | | 4/1987 | Rifkin |
| 4,666,423 | A | | 5/1987 | Herrington |
| 4,672,723 | A | | 6/1987 | Hugues et al. |
| 4,673,383 | A | | 6/1987 | Bentsen |
| 4,684,359 | A | | 8/1987 | Herrington |
| 4,693,152 | A | | 9/1987 | Grosz et al. |
| 4,708,617 | A | | 11/1987 | Herrington |
| 4,710,968 | A | | 12/1987 | Borchardt et al. |
| 4,714,454 | A | | 12/1987 | Herrington |
| 4,714,455 | A | | 12/1987 | Herrington |
| 4,717,372 | A | | 1/1988 | Herrington |
| 4,717,373 | A | | 1/1988 | Catchman et al. |
| 4,721,501 | A | | 1/1988 | Herrington |
| 4,721,502 | A | | 1/1988 | Herrington |
| 4,731,911 | A | | 3/1988 | Gould |
| 4,732,065 | A | | 3/1988 | Herrington |
| 4,736,450 | A | | 4/1988 | Van Erden et al. |
| 4,736,451 | A | | 4/1988 | Ausnit |
| 4,736,496 | A | | 4/1988 | Fisher et al. |
| 4,741,789 | A | | 5/1988 | Zieke et al. |
| 4,747,702 | A | | 5/1988 | Scheibner |
| 4,756,629 | A | | 7/1988 | Tilman et al. |
| 4,759,246 | A | | 7/1988 | Herrington |
| 4,764,977 | A | | 8/1988 | Wagers |
| 4,778,282 | A | | 10/1988 | Borchardt et al. |
| 4,786,189 | A | | 11/1988 | Broderick et al. |
| 4,786,191 | A | | 11/1988 | Broderick et al. |
| 4,787,754 | A | | 11/1988 | Herrington |
| 4,787,880 | A | | 11/1988 | Ausnit |
| 4,791,843 | A | | 12/1988 | Herrington et al. |
| 4,792,240 | A | | 12/1988 | Ausnit |
| 4,792,241 | A | | 12/1988 | Broderick et al. |
| 4,795,269 | A | | 1/1989 | Scheibner |
| 4,795,412 | A | | 1/1989 | Herrington |
| 4,795,599 | A | | 1/1989 | Herrington |
| 4,808,150 | A | | 2/1989 | Herrington et al. |
| 4,812,056 | A | * | 3/1989 | Zieke ..... 383/65 |
| 4,813,794 | A | | 3/1989 | Herrington |
| 4,817,188 | A | | 3/1989 | Van Erden |
| 4,822,539 | A | | 4/1989 | Tilman et al. |
| 4,829,641 | A | | 5/1989 | Williams |
| 4,832,507 | A | | 5/1989 | Herrington |
| 4,840,012 | A | | 6/1989 | Boeckmann |
| 4,842,420 | A | | 6/1989 | DiBiasi et al. |
| 4,842,421 | A | | 6/1989 | Bullard et al. |
| 4,844,759 | A | | 7/1989 | Boeckmann |
| 4,850,946 | A | | 7/1989 | Broderick et al. |
| 4,854,017 | A | | 8/1989 | Kamp |
| 4,858,286 | A | | 8/1989 | Siegel |
| 4,863,286 | A | | 9/1989 | Branson |
| 4,878,763 | A | | 11/1989 | Ausnit |
| 4,885,196 | A | | 12/1989 | Herrington |
| 4,890,935 | A | | 1/1990 | Ausnit et al. |
| 4,892,414 | A | | 1/1990 | Ausnit |
| 4,906,108 | A | | 3/1990 | Herrington et al. |
| 4,906,310 | A | | 3/1990 | Broderick et al. |
| 4,907,321 | A | | 3/1990 | Williams |
| 4,913,560 | A | | 4/1990 | Herrington |
| 4,917,506 | A | | 4/1990 | Scheibner |
| 4,922,588 | A | | 5/1990 | Borchardt et al. |
| 4,927,574 | A | | 5/1990 | Herrington |
| 4,929,255 | A | | 5/1990 | Hakulin et al. |
| 4,929,487 | A | | 5/1990 | Tilman et al. |
| 4,941,307 | A | | 7/1990 | Wojcik |
| 4,947,525 | A | | 8/1990 | Van Erden |
| 4,949,527 | A | | 8/1990 | Boeckmann et al. |
| 5,004,356 | A | | 4/1991 | Matsui |
| 5,007,142 | A | | 4/1991 | Herrington |
| 5,007,143 | A | | 4/1991 | Herrington |
| 5,007,146 | A | | 4/1991 | Meidan |
| 5,010,627 | A | | 4/1991 | Herrington et al. |
| 5,012,561 | A | | 5/1991 | Porchia et al. |
| 5,014,498 | A | | 5/1991 | McMahon |
| 5,014,852 | A | | 5/1991 | Herrington et al. |
| 5,017,021 | A | | 5/1991 | Simonsen et al. |
| 5,019,027 | A | | 5/1991 | Boeckmann et al. |
| 5,020,194 | A | | 6/1991 | Herrington et al. |
| 5,024,537 | A | | 6/1991 | Tilman |
| 5,026,563 | A | | 6/1991 | Van Erden et al. |
| 5,044,774 | A | | 9/1991 | Bullard et al. |
| 5,048,692 | A | | 9/1991 | Handler et al. |
| 5,053,091 | A | | 10/1991 | Giljam et al. |
| 5,063,069 | A | | 11/1991 | Van Erden et al. |
| 5,063,639 | A | | 11/1991 | Boeckmann et al. |
| 5,063,644 | A | | 11/1991 | Herrington et al. |
| 5,065,899 | A | | 11/1991 | Tilman |
| 5,067,208 | A | | 11/1991 | Herrington, Jr. et al. |
| 5,067,302 | A | | 11/1991 | Boeckmann |
| 5,070,583 | A | | 12/1991 | Herrington |
| 5,070,584 | A | | 12/1991 | Dais et al. |
| 5,071,689 | A | | 12/1991 | Tilman |
| 5,078,930 | A | | 1/1992 | Herrington, Jr. |
| 5,088,971 | A | | 2/1992 | Herrington |
| 5,131,121 | A | | 7/1992 | Herrington, Jr. et al. |
| 5,138,750 | A | | 8/1992 | Gundlach et al. |
| 5,140,727 | A | | 8/1992 | Dais et al. |
| 5,141,577 | A | | 8/1992 | Porchia et al. |
| 5,152,613 | A | | 10/1992 | Herrington, Jr. |

5,161,286 A 11/1992 Herrington, Jr. et al.
5,189,764 A 3/1993 Herrington et al.
5,198,055 A 3/1993 Wirth et al.
5,209,574 A 5/1993 Tilman
5,211,481 A 5/1993 Tilman
5,211,482 A 5/1993 Tilman
5,248,201 A 9/1993 Kettner et al.
5,259,904 A 11/1993 Ausnit
5,283,932 A 2/1994 Richardson et al.
5,301,394 A 4/1994 Richardson et al.
5,301,395 A 4/1994 Richardson et al.
5,335,997 A 8/1994 Kanemitsu et al.
5,351,369 A 10/1994 Swain
5,356,222 A 10/1994 Kettner et al.
5,358,334 A 10/1994 Simonsen
5,363,540 A 11/1994 Dais et al.
5,366,294 A 11/1994 Wirth et al.
5,368,394 A 11/1994 Scott et al.
5,382,094 A 1/1995 Ausnit
5,383,989 A 1/1995 McMahon
5,386,616 A 2/1995 Norwell
5,397,182 A 3/1995 Gaible et al.
5,403,094 A 4/1995 Tomic
5,405,478 A 4/1995 Richardson et al.
5,405,629 A 4/1995 Marnocha et al.
5,415,904 A 5/1995 Takubo et al.
5,417,035 A 5/1995 English
5,426,830 A 6/1995 Richardson et al.
5,431,760 A 7/1995 Donovan
5,442,837 A 8/1995 Morgan
5,442,838 A 8/1995 Richardson et al.
5,448,807 A 9/1995 Herrington, Jr.
5,448,808 A 9/1995 Gross
5,456,928 A 10/1995 Hustad et al.
5,462,360 A 10/1995 Tilman et al.
5,480,230 A 1/1996 May
5,482,375 A 1/1996 Richardson et al
5,486,255 A 1/1996 Simonsen
5,509,734 A 4/1996 Ausnit
5,511,884 A 4/1996 Bruno et al.
5,557,907 A 9/1996 Malin et al.
5,558,439 A 9/1996 Tilman
5,558,613 A 9/1996 Tilman et al.
5,566,429 A 10/1996 Martinez et al.
5,573,614 A 11/1996 Tilman et al.
5,577,305 A 11/1996 Johnson
5,592,802 A 1/1997 Malin et al.
5,618,111 A 4/1997 Porchia et al.
5,625,927 A 5/1997 Chu
5,636,415 A 6/1997 James
5,638,586 A 6/1997 Malin et al.
5,664,299 A 9/1997 Porchia et al.
5,664,406 A 9/1997 Smith
5,669,715 A 9/1997 Dobreski et al.
5,682,730 A 11/1997 Dobreski
5,713,669 A 2/1998 Thomas et al.
5,722,128 A 3/1998 Toney et al.
5,749,658 A 5/1998 Kettner
5,768,852 A 6/1998 Terminella et al.
5,769,772 A 6/1998 Wiley
5,775,812 A 7/1998 St. Phillips et al.
5,780,067 A 7/1998 Herrington, Jr.
5,788,378 A 8/1998 Thomas
5,809,621 A * 9/1998 McCree et al. ..... 24/399
5,827,163 A 10/1998 Kettner
5,833,791 A 11/1998 Bryniarski et al.
5,836,056 A 11/1998 Porchia et al.
5,851,070 A 12/1998 Dobreski et al.
5,867,875 A 2/1999 Beck et al.
5,871,281 A 2/1999 Stolmeier et al.
5,896,627 A 4/1999 Cappel et al.
5,901,625 A 5/1999 May
5,911,508 A 6/1999 Dobreski et al.
5,919,535 A 7/1999 Dobreski et al.
5,924,173 A 7/1999 Dobreski et al.
5,931,582 A 8/1999 Nichols
5,950,285 A 9/1999 Porchia et al.
5,953,796 A 9/1999 McMahon et al.
5,955,160 A 9/1999 Tanaka et al.
5,956,815 A 9/1999 O'Connor et al.
5,964,532 A 10/1999 St. Philips et al.
5,965,224 A 10/1999 Chen et al.
6,009,603 A 1/2000 Gallagher
6,010,244 A 1/2000 Dobreski et al.
6,014,795 A 1/2000 McMahon
6,021,557 A 2/2000 Dais et al.
6,036,364 A 3/2000 Heuvel
6,047,450 A * 4/2000 Machacek ..... 24/399
6,071,011 A 6/2000 Thomas et al.
6,112,374 A 9/2000 Van Erden
6,131,369 A 10/2000 Ausnit
6,138,439 A 10/2000 McMahon et al.
6,148,588 A 11/2000 Thomas et al.
6,161,271 A 12/2000 Schreiter
6,178,602 B1 1/2001 Burke et al.
6,178,722 B1 1/2001 McMahon
6,182,337 B1 2/2001 Machacek et al.
6,199,256 B1 3/2001 Revnew et al.
6,212,857 B1 4/2001 Van Erden
6,213,641 B1 4/2001 Price
6,216,423 B1 4/2001 Thieman
6,244,021 B1 6/2001 Ausnit et al.
6,247,843 B1 6/2001 Buchman
6,257,763 B1 7/2001 Stolmeier
6,264,366 B1 7/2001 Custer
6,273,607 B1 8/2001 Buchman
6,279,298 B1 8/2001 Thomas et al.
6,286,189 B1 9/2001 Provan
6,286,191 B2 9/2001 Van Erden
6,286,999 B1 9/2001 Cappel et al.
6,287,000 B1 9/2001 Buchman
6,287,001 B1 9/2001 Buchman
6,289,561 B1 9/2001 Provan et al.
6,290,390 B1 9/2001 Buchman
6,290,391 B1 9/2001 Buchman
6,290,393 B1 9/2001 Tomic
6,292,986 B1 9/2001 Provan et al.
6,293,701 B1 9/2001 Tomic
6,293,896 B1 9/2001 Buchman
6,299,720 B1 10/2001 Van Erden
6,306,071 B1 10/2001 Tomic
6,327,754 B1 12/2001 Belmont et al.
6,327,837 B1 12/2001 Van Erden
2001/0001164 A1 5/2001 Van Erden
2001/0002504 A1 6/2001 Provan et al.
2001/0005971 A1 7/2001 Thieman
2001/0005973 A1 7/2001 Schneider et al.
2001/0012414 A1 8/2001 Price
2001/0017947 A1 8/2001 Strand et al.
2001/0017950 A1 8/2001 Strand et al.
2001/0021280 A1 9/2001 Thomas
2001/0026649 A1 10/2001 Catchman
2001/0039235 A1 11/2001 Buchman
2001/0039783 A1 11/2001 McMahon et al.
2001/0039784 A1 11/2001 McMahon et al.
2001/0042357 A1 11/2001 McMahon et al.
2001/0042358 A1 11/2001 McMahon et al.
2001/0043762 A1 11/2001 Cappel et al.
2001/0044990 A1 11/2001 Turvey et al.
2001/0045083 A1 11/2001 McMahon et al.
2002/0009239 A1 1/2002 Cappel et al.

* cited by examiner

ZIPPERED RESEALABLE CLOSURE

This application claims priority from provisional U.S. patent application serial No. 60/189,518 filed Mar. 15, 2000 entitled, "Zippered Resealable Closure" and bearing, the disclosure of which is incorporated herein, in its entirety, by reference.

TECHNICAL FIELD

The present invention relates to resealable closure devices for storage containers and other applications.

BACKGROUND ART

Resealable closure assemblies have become a fixture of the storage container industry. Thermoplastic bags, in particular, have gone through several stages of closure devices.

It is known in the prior art to provide plastic bags with mating profiles, so that a bag may be sealed by applying force with the fingers to cause the profiles to mate and un sealed by applying force with the fingers to cause the profiles to disengage.

Slider assemblies are also known for achieving sealing and unsealing of suitably fitted plastic bags. Use of a slider facilitates sealing and unsealing of such plastic bags. Slider assemblies include profile strips with male and female elements working in cooperation with a slider that straddles the top of the strips. The slider serves to join the male and female elements together when drawn in one direction, and to separate the profiles when drawn in the opposite direction. Generally, the elements are forced apart, one element at a time, by a separating finger on a top inside panel of the slider.

SUMMARY OF THE INVENTION

In a first embodiment, a zipper profile for a fastener assembly includes a male element and a female element. The female element has a pair of jaws that are movable with respect to one another about a common fulcrum region. The female element also has a pair of arms each of which is coupled to a corresponding one of the pair of jaws at the fulcrum region. Each of the arms has an end opposite from the fulcrum region that is shaped for engagement with a slider. The jaws have an open position and a closed position, and the arms are disposed to cause movement of the jaws between the closed position and the open position when the arms experience displacement about the fulcrum region. Such displacement about the fulcrum region is effectuated by motion of the slider relative to the arms. The male element is captured by the female element when the jaws are in the closed position and released when the jaws are in the open position.

In accordance with another embodiment of the invention, the male element includes an end region for engagement with the slider. In a further embodiment, one of the jaws of the female element includes a first hook and the male element includes a tip having a second hook. The first and second hooks become engaged when the jaws are closed.

In another embodiment of the invention, a fastener assembly includes a first profile strip with a female element having a pair of jaws which are movable with respect to one another about a common fulcrum region. The female element of the first profile strip also includes a pair of arms that are coupled to a corresponding one of the pair of jaws at the fulcrum region. Each of the pair of arms has an end opposite from the fulcrum region shaped for engagement with a slider. The jaws have an open position and a closed position, and the arms are disposed to cause movement of the jaws between the closed position and the open position when the arms experience displacement about the fulcrum region. Such displacement about the fulcrum region is effectuated by motion of the slider relative to the arms. The fastener assembly also has a second profile strip with a male element. The male element is captured by the female element when the jaws are in the closed position and released when the jaws are in the open position. A slider is longitudinally movable relative to the strips so as to cause the arms to experience displacement about the fulcrum region.

In accordance with another aspect of the invention the first profile strip has a rest position near a longitudinal end. One of the arms is truncated, so that when the slider is positioned at the rest position, the slider will not cause the arms to experience displacement about the fulcrum region and the jaws assume the closed position.

In still further embodiments of the invention, the slider has a leading end and a trailing end. (In the embodiments illustrated in the accompanying drawings, the "leading end" is the wide end of the slider and the "trailing end" is the narrow end of the slider.) The slider also has a cross section that includes a first channel for capturing the ends of the arms and a second channel for capturing the end region of the male element. The channels experience a change in separation along a longitudinal axis, with the separation being greater at the leading end than at the trailing end. In this manner, motion of the slider in the direction of the trailing end pulls the end region of the male element away from the ends of the arms, while the jaws are in an open position, and the male element is pulled away from the female element. Additionally, the second channel may have an entrance and includes a restriction at the entrance near the leading end of the slider. The restriction limits angular motion of the tip of the male member and facilitates engagement of the tip with the first hook as the jaws assume a closed position.

In this embodiment, the slider cross section has a top and a bottom, and first and second channels may be disposed in the cross section so that they are vertically offset from one another. Additionally, the separation between the channels may remain constant in a second region near the trailing end of the slider, and the separation may increase progressively in a first region near the leading end of the slider, with the separation being relatively greater at the leading end. The first channel may also (or alternatively) decrease in width progressively in the second region (the width being relatively greater near the trailing end) and remain at a substantially constant width in the first region.

In accordance with another aspect of the invention, a method of removably fastening a first side panel to a second side panel is provided. The first side panel has a first profile strip that includes a female element having a pair of jaws, the jaws having an open position and a closed position and being actuatable by longitudinal motion of a slider, and the second side panel has a second profile strip that includes a male element. The method of this embodiment includes providing a slider longitudinally movable relative to the strips. A first longitudinal region of the slider is used to maintain the jaws in an open position while causing the male element to be displaced into the jaws, and a second longitudinal region of the slider is used to cause the jaws to move from an open position to a closed position. The slider is slid longitudinally along the strips so that the strips transition into a state wherein, along at least a portion of the strips, the male element is within the jaws and the jaws are closed.

In accordance with a further embodiment of the invention, a method for manufacturing a fastener assembly includes providing a first profile strip with a female element having a pair of arms, each of the arms having an distal end shaped for engagement with a slider. A second profile strip with a male element having an end region for engagement with the slider is also provided, as well as a slider that has a first side leg depending from one end of a top portion and a second side leg depending from an opposite end of the top portion. The end region of the male element is nullified for a length greater than the length of the slider, and a top arm of the female element is also nullified for a length greater than the length of the slider. A lower end of the first side leg of the slider is engaged with a bottom arm of the female element, and the top portion of the slider is rotated until the slider straddles the profile strips.

In a further embodiment, the method includes providing a first side panel and a second side panel, the first side panel depending from a lower jaw of the female element and the second side panel depending from the male element. After rotating the top portion of the slider, the slider is moved along the profiles to engage the uncut arms of the female profile and the end region of the male portion. The method also includes cutting through the profiles and panels to form components of a resealable enclosure.

In accordance with another embodiment of the present invention method for forming profile strips for a resealable closure includes extruding a molten material through a die. The die has an opening that approximates the shape of a desired profile. The molten material is drawn away from the die such that the molten material falls into a water bath. The molten material is then sized in the water bath. The molten material may be sized by a sizing device having a first portion for placing external bounds on the molten material and a second portion for preserving an interior space of the molten material.

In accordance with yet another embodiment of the present invention, a method for forming profile strips for a resealable closure includes extruding a molten material through a die having an opening that approximates the shape of a desired profile. The molten material is drawn away from the die and falls into a water bath. The water bath has a first region and a second region, the first region being controlled at a selected warmer temperature than the second region.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENT

Figure 1:
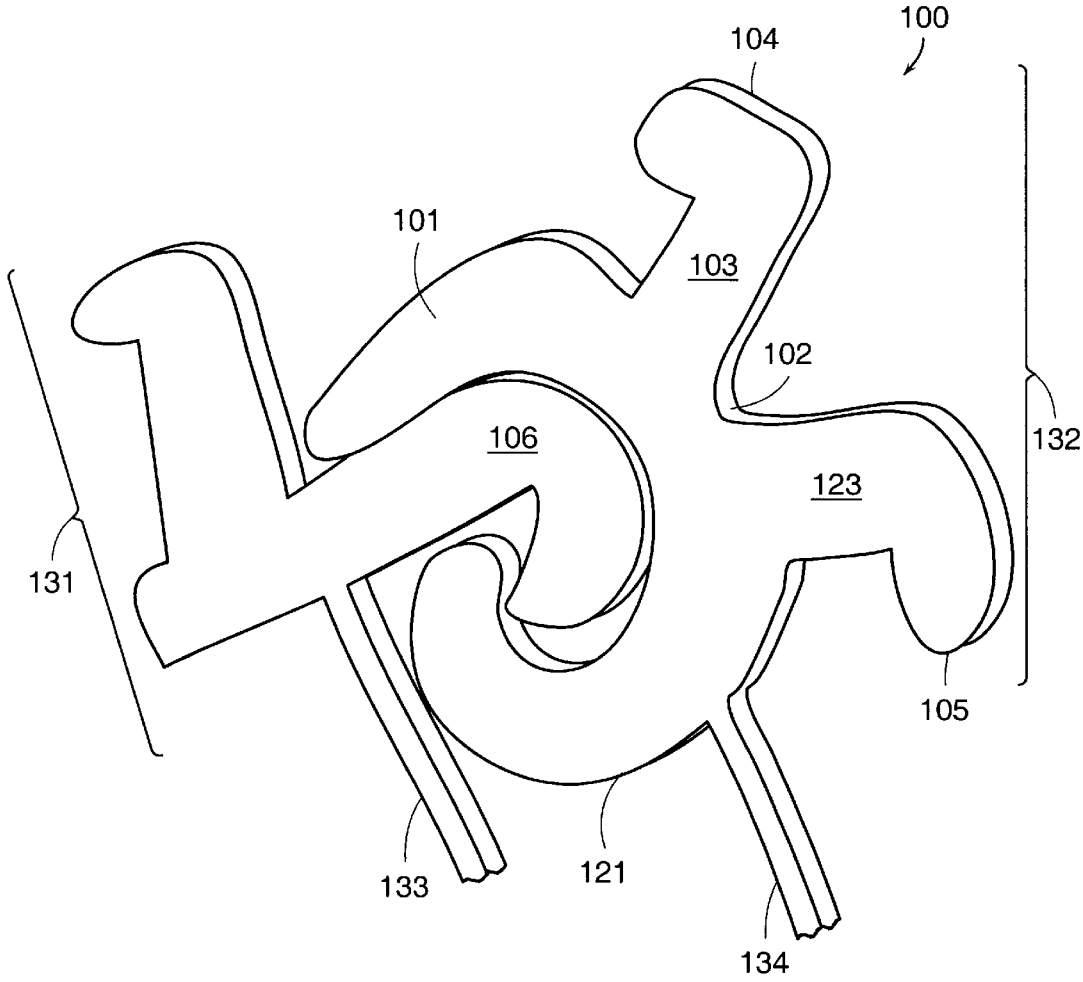
FIG. 1 is a cross section of a zipper profile according to an embodiment of the present invention.

FIG. 1 is a cross section of a zipper profile according to an embodiment of the present invention. A female element 100 has a pair of jaws 101 and 121 that move with respect to one another about a fulcrum region 102. A pair of arms 103 and 123 are coupled to a corresponding one of the pair of jaws 101 and 121 at the fulcrum region 102. The arms 103 and 123 may each have an end 104 and 105 opposite from the fulcrum region 102 that is shaped for engagement with a slider, in a manner discussed with respect to the figures below. A male element 106 may be captured when the jaws 101 and 121 are in a closed position and released when the jaws are in an open position. Each of these elements 100 and 106 can be understood as having a profile portion, 131 and 132 respectively, for engagement and disengagement, as well as a fin portion, 133 and 134 respectively, for attachment, for example, to walls of a suitable enclosure. We sometimes refer to an element with its associated profile portion as a "profile strip".

Figure 2:
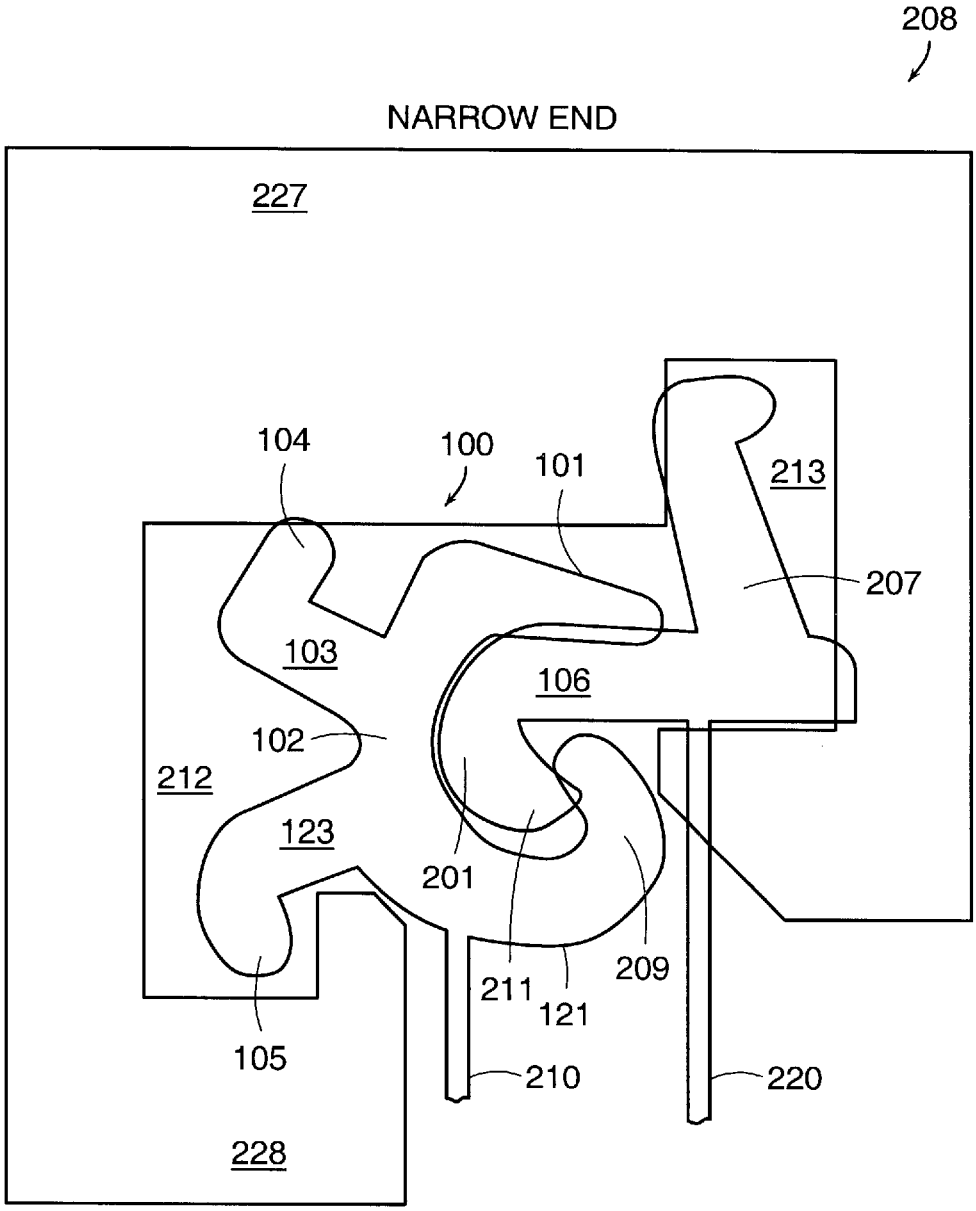
FIGS. 2 is a diagrammatic cross sectional view of an embodiment taken through the narrow end of the slider.
Figure 3:
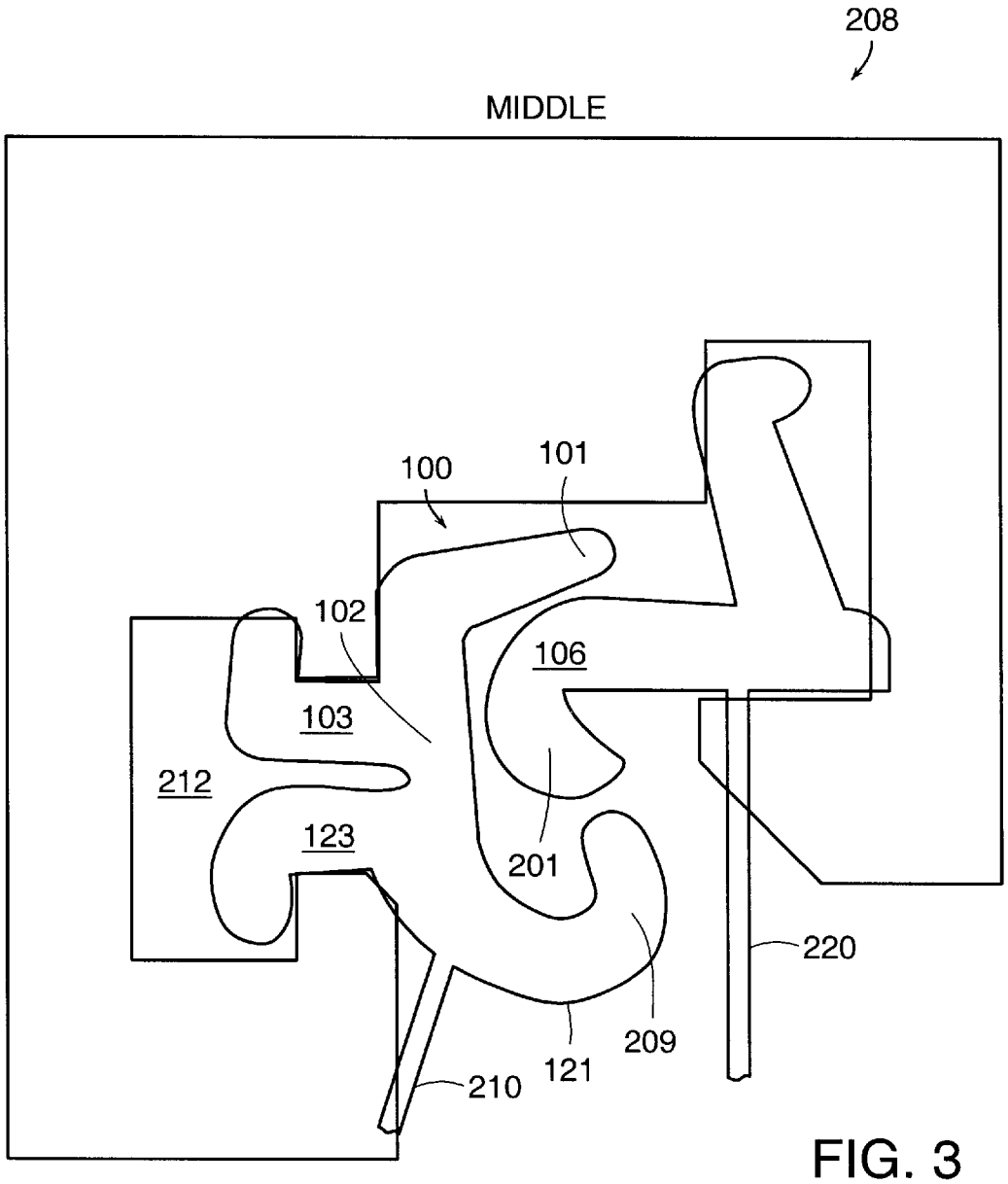
FIG. 3 is a diagrammatic cross sectional view of the embodiment of FIG. 2 taken through the middle of the slider.
Figure 4:
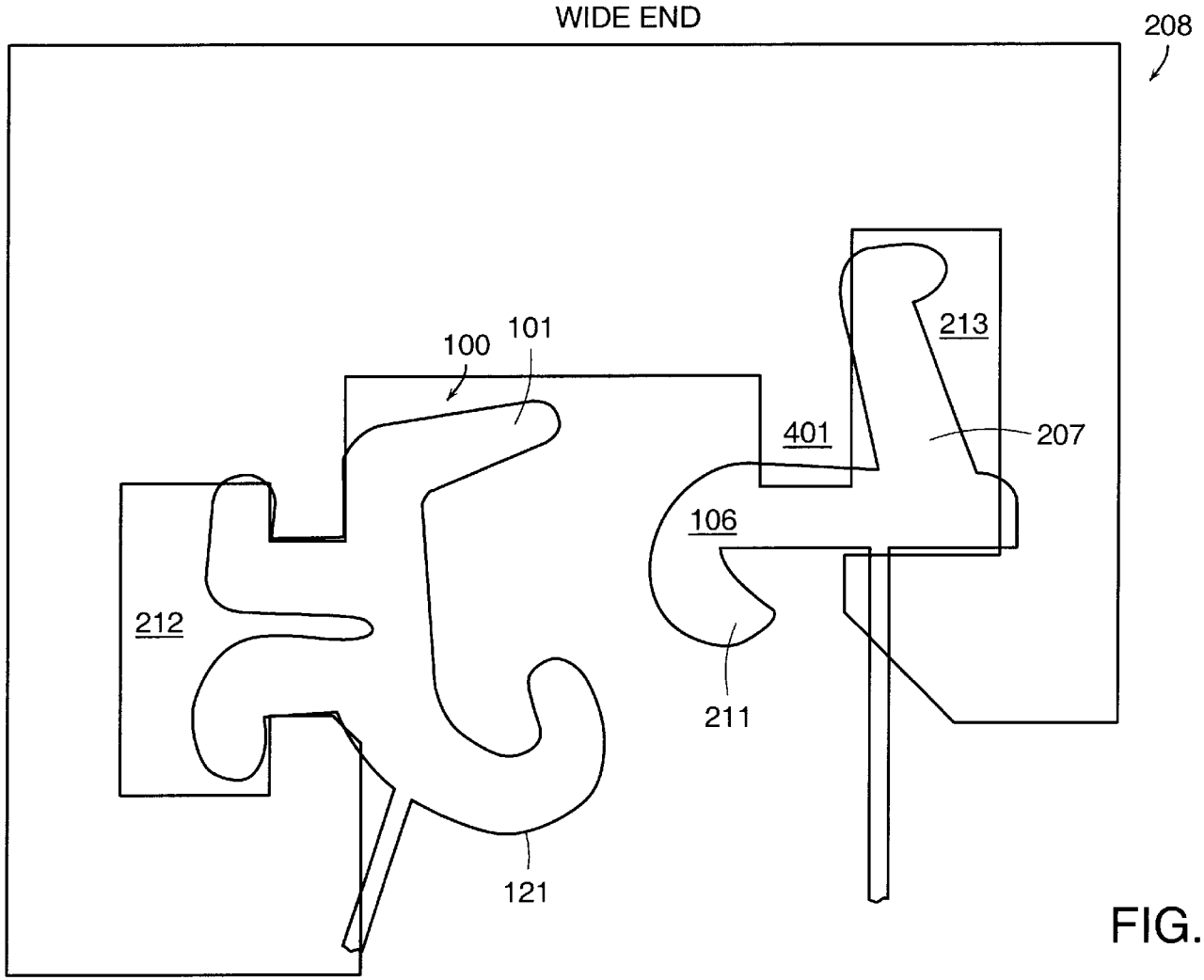
FIG. 4 is a diagrammatic cross sectional view of the embodiment of FIG. 2 taken through the wide end of the slider.

FIGS. 2–4 are sectional views showing a fastener assembly according to one embodiment of the present invention. FIG. 2 is a diagrammatic cross sectional view of an embodiment taken through the narrow end of the slider. FIG. 3 is a diagrammatic cross sectional view of the embodiment of FIG. 2 taken through the middle of the slider, and FIG. 4 is a diagrammatic cross sectional view of the embodiment of FIG. 2 taken through the wide end of the slider. (We sometimes refer to the narrow end of the slider as the "trailing end" and the wide end as the "leading end".) A female element 100 of a first profile strip 210 has a pair of jaws 101 and 121 that move with respect to one another about a fulcrum region 102. Each of a pair of arms 103 and 123 is coupled to a corresponding one of the pair of jaws 101 and 121 at the fulcrum region 102. The arms 103 and 123 each have an end 104 and 105, opposite from the fulcrum region 102, that is shaped for engagement with a slider 208. A male element 106 on a second profile strip 220 includes an end region 207 for engagement with the slider 208. One of the jaws 121 of the female element 100 includes a first hook 209 and the male element 106 includes a tip 201 having a second hook 211. As will be shown in further detail below, in this embodiment, the arms 103 and 123, acting through the fulcrum region 102, are squeezed together to open the jaws 101 and 121 in a manner akin to squeezing the ends of a spring-loaded clothespin to open the clothespin.

The slider 208 has a cross section including a first channel 212 for capturing the ends 104 and 105 of the arms 103 and 123, and a second channel 213 for capturing the end region 207 of the male element 106. The channels 212 and 213 experience a change in separation along a longitudinal axis. There is no change between the trailing end in FIG. 2 and the middle in FIG. 3. Nevertheless, as the slider moves relative to a point in the profile, so that the point has shifted from the trailing end to the middle—that is the slider is moved in the direction of the trailing end—the jaws have been caused to open, but the male element remains inside them. The jaws are caused to open because the first channel 212 decreases progressively in width between the trailing end in FIG. 2 and the middle in FIG. 3; the decreased width causes the arms 103 and 123 to be forced together, thereby opening jaws 101 and 121. In coordination with the operation of the jaws, once the jaws have been caused to be open at the middle of the slider, the separation between the channels 212 and 213 increases progressively from the middle of the slider to the leading end shown in FIG. 4. In this way, motion of the slider 208 in the direction of the trailing end pulls the male element 106 clear from the ends of the arms 103 and 123, while the jaws 101 and 121 are held in an open position. Consequently, the male element 106 is pulled away from the female element 100. Of course, the use of the term "middle" in relation to the slider is relative. The precise location for transitions between no change and progressive change in separation between channels 212 and 213 is a matter of design choice, and similarly the location for transition between no change and progressive change in width of channel 212 is a matter of design choice. Moreover these transition locations need not be in precisely the same place.

In this embodiment, the cross section of the slider 208 has a top 227 and a bottom 228. The first and second channels 212 and 213 are disposed in the cross section so that they are vertically offset from one another.

FIG. 2 shows how the first hook 209 and the second hook 211 are engaged when the jaws 101 and 121 are in a closed position at the narrow end of the slider 208. At the narrow end of the slider 208, the channels 212 and 213 are relatively close together. Consequently, the female element 100 and the male element 106 are pushed toward one another. The first hook 209 cradles the tip 201, and the hook 211 of the male element interlocks with the first hook 209 to ensure a tight seal. When the narrow end of the slider of FIG. 2 has passed over the length of the profile strips 210 and 220, the strips have been fastened to one another. Motion of the slider in the opposite direction has the effect of unfastening the strips, since the process described above is reversible.

FIG. 3 is a diagrammatic cross sectional view of the embodiment of FIG. 2 taken through the middle of the slider. This figure shows that as the slider 208 begins to move over the profile strips 210 and 220 in the direction of the trailing end, the width of the first channel 212 has been diminished, so as to pinch together the arms 103 and 123 of the female element 100. The arms 103 and 123 are displaced about the fulcrum region 102, and the jaws 101 and 121 open to disengage the first hook 209 from the second hook 201.

FIG. 4 is a diagrammatic cross sectional view of the embodiment of FIG. 2 taken through the wide end of the slider. This figure shows that at a wide end of the slider 208, the jaws 101 and 121 of the female element 100 are in an open position, and the distance between the channels 212 and 213 of the slider 208 is at a maximum. The male element 106 and the female element 100 are completely separated, and the male element 106 is wholly released from the jaws 101 and 121. A projection 401 provides a restriction at the opening of channel 213 to prevent angular motion of the tip 211 of the male element 106 relative to the end region 207. In this way, the tip 211 is constrained by the projection 401 from moving toward the end region 207, and remains in position so that it can easily re-enter the jaws 101 and 121 of the female element 100 when the slider is moved in the direction of its leading end.

Figure 5:
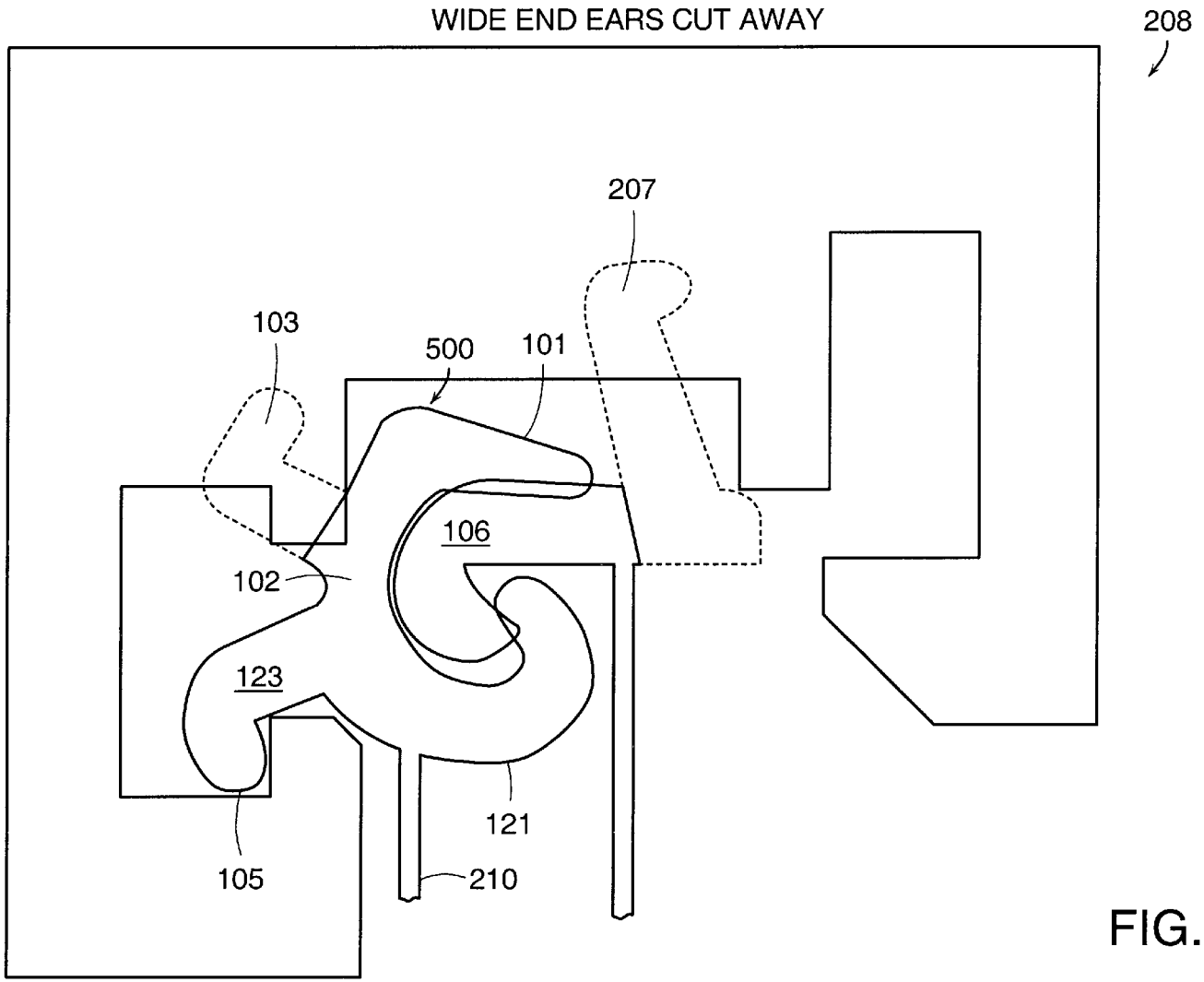
FIG. 5 is a diagrammatic cross sectional view of the embodiment of FIG. 2 showing modification of the profile in the rest region.

FIG. 5 is a diagrammatic cross sectional view of the embodiment of FIG. 2 showing modification of the profile in the rest region. The rest region is formed near a longitudinal end of the first profile strip 210, and it is this end that is illustrated in cross section in FIG. 5. The rest region prevents leakage by providing a place for the wide end of the slider 208 to rest when the zipper is closed. In the rest region, the female element 500 has one of its arms 103 truncated, so that when the slider 208 is positioned in the rest region, the slider will not cause the arms 103 and 123 to experience displacement about the fulcrum region 102, and the jaws 101 and 121 therefore assume the closed position. Preferably, the end portion 207 of the male element is also truncated. Since the portion of the profile that is within the wide end of the slider 208 is incomplete—in that one of the pair of arms is absent and the male end portion 207 is also preferably absent—the slider 208 is not able to open the jaws 101 and 121 or pull apart the male element 106 from the female element 500. Consequently, the male element 106 and female element 500 remain closed. It should be noted that the length of arm 103 cut away or left out of the first profile strip 210 is preferably less than the length of the slider 208 so that the entire profile 210 is engaged in just the narrow end of the slider 208. In this way the profile 210 stays threaded within the slider 208 so that when the slider 208 is drawn in the direction of the trailing end to separate the male and female elements, the entire profile 210 moves into the full length of the slider 208, opening the profile.

Figure 6:
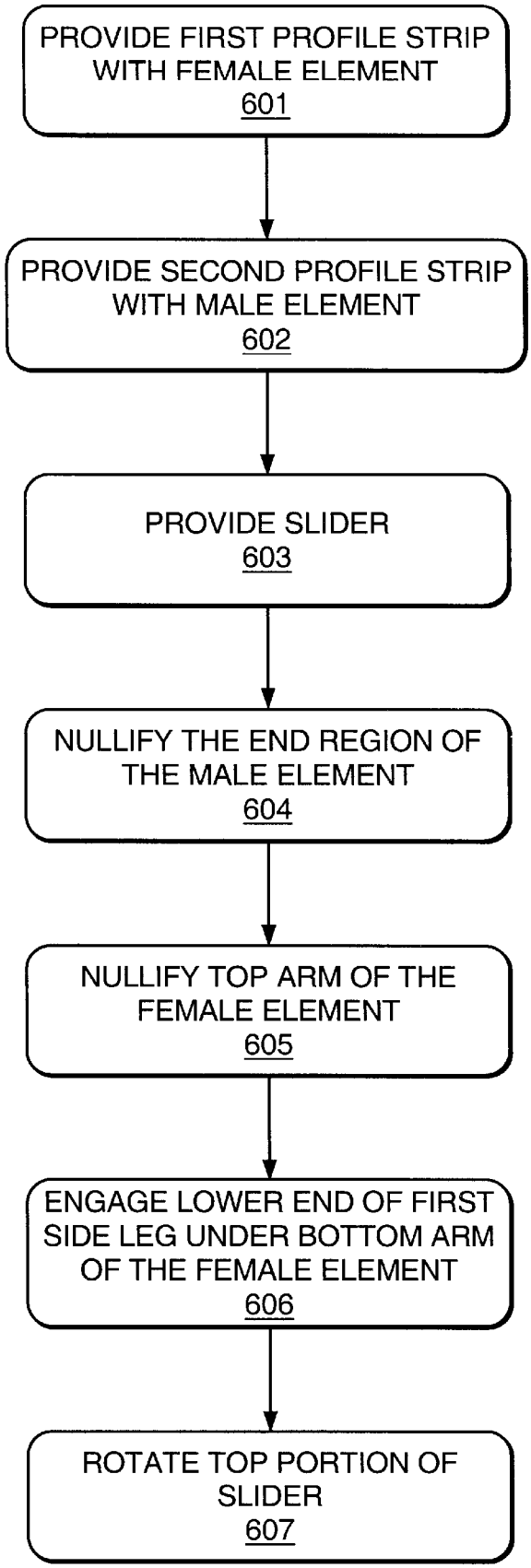
FIG. 6 is a block diagram illustrating steps of a method of manufacturing a fastener assembly according to another embodiment of the present invention.

FIG. 6 is a block diagram illustrating steps of a method of manufacturing a fastener assembly according to another embodiment of the present invention. A first profile strip including a female element having a pair of arms is provided in process 601. Each of the arms has a distal end shaped for engagement with a slider. A second profile strip is also provided in process 602. The second profile strip includes a male element with an end region for engagement with a slider. Further, a slider having a first side leg depending from one end of a top portion and a second side leg depending from an opposite end of the top portion is provided in process 603.

The end region of the male element is nullified in process 604 for a length greater than the length of the slider. Additionally, a top arm of the female element is nullified in process 605 for a length greater than the length of the slider. As will be described in further detail with respect to FIG. 7, a lower end of the first side leg of the slider is engaged with a bottom arm of the female element in process 606 and the top portion of the slider is rotated in process 607 until it straddles the profile strips.

Figure 7:
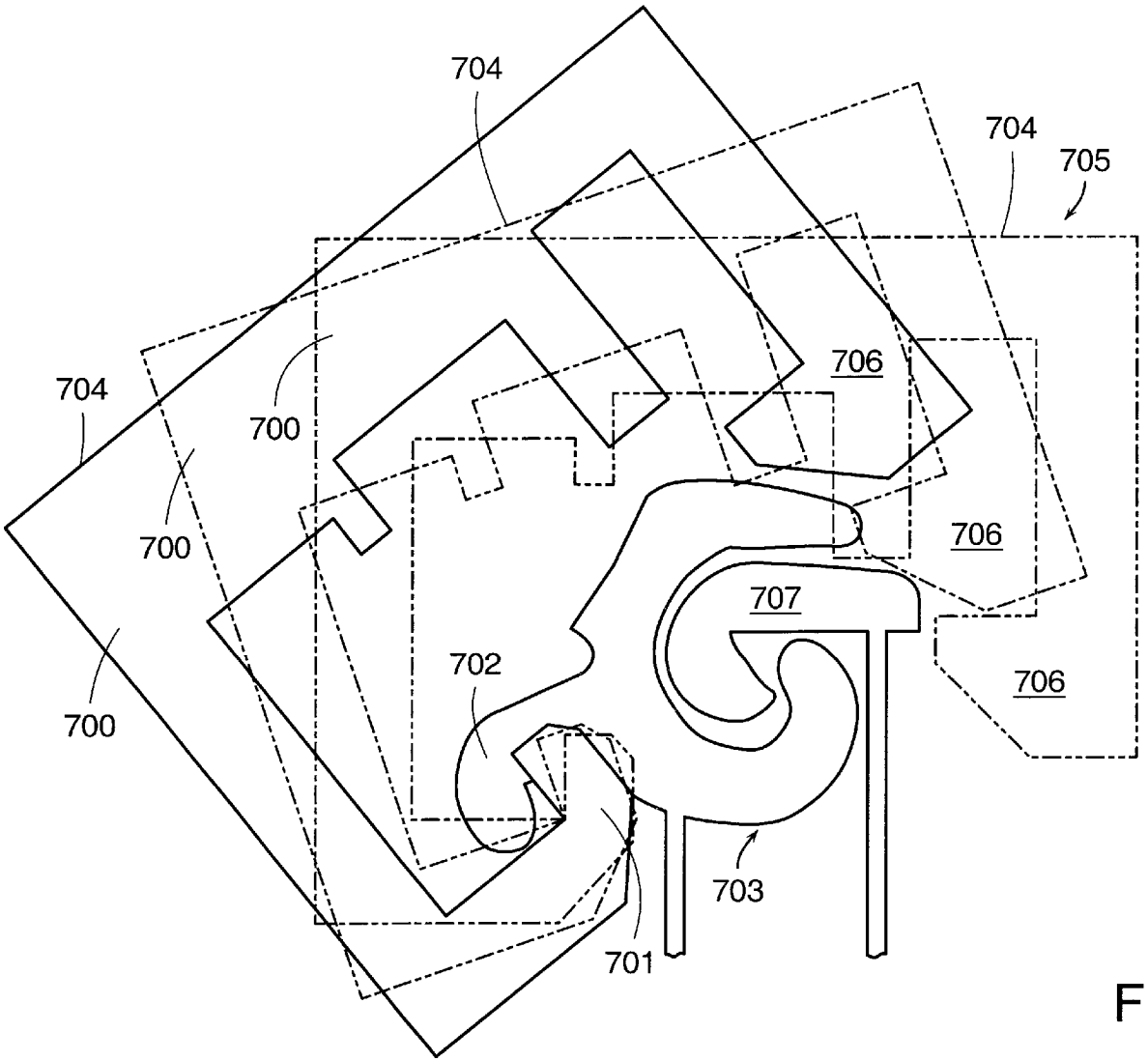
FIG. 7 is a cross section illustrating the manner of affixing the slider in the embodiment of FIG. 6.

FIG. 7 is a cross section illustrating the manner of affixing the slider in the embodiment of FIG. 6. Again, a lower end 701 of the first side leg 700 is engaged with the bottom arm 702 of the female element 703 and a top portion 704 of the slider 705 is rotated until the slider's first side leg 700 and the second side leg 706 straddle the profile strips. To provide clearance for rotation of the slider in this manner, for a length greater than the slider, the top arm of the female element 703 and the end region of the male element 707 are nullified. One method of nullification is simply to remove these items. Alternatively, the items may be flattened by use of suitable thermoforming equipment, or alternatively they may be partially removed to obtain sufficient clearance. Later, when the slider 705 is moved along the profile strips, it leaves the region where the top arm of the female element 703 and the end region of the male element 707 are nullified, engages the unmodified arms of the female element 703 and unmodified end region of the male element 707 (in a manner shown generally in FIGS. 2–4) into the appropriate channels in the slider 705.

If the fastener assembly is attached to sheets of plastic to make a resealable plastic bag, the cutoff between the bags is made through the nullified region, and an end stop is applied, leaving just enough nullified region to engage only the wide end of the slider 705, so as to form the rest region previously described.

The profile strips of the invention may be formed by any suitable method. They may be extruded through a die or injection molded. For example, a molten plastic material may be extruded through a die which has an opening approximately the shape of the desired profile, but larger in scale. The molten profile is typically (although not necessarily) drawn away from the die at a speed higher than the rate at which the molten material leaves the die, thus drawing down the profile to a smaller cross sectional size. The molten profile is then cooled, typically by submerging it in a bath of water, or by spraying water.

In forming the profile strips, attention must be paid to the shape of the female element 100 which affects performance. The geometry of the jaws 101 and 121 and of the arms 103 and 123 determines the effectiveness of the closure to resist inadvertent opening, and also the ease with which the assembly can be zipped and unzipped.

One method of manufacturing is to design the die so it results in the desired profile shape, then extrude the molten plastic into water, adjusting the operating conditions to fine-tune the resulting product shape. For the female element 100, it has been found that a number of operating parameters affect this shape. Specifically, the female element's jaw geometry is made more closed (forming a tighter closure) by the following: 1) larger distance between the die and the water surface; 2) warmer water; 3) higher speed; and 4) less draw-down (slower take off speed).

An embodiment of this method is to establish gap, speed, and draw-down to satisfy other product and process requirements, then adjust the water temperature to control shape. However, the highest speed can be achieved with the coolest water, so using warmer water requires sacrifice in speed. In order to have the control without sacrificing speed, the water bath may be zoned so there is a section where the molten material first enters that is controlled to a warmer temperature, and the remainder of the bath is as cold as practical. In an embodiment, this zoned region covers about twenty percent of the track's under water path.

Figure 8:
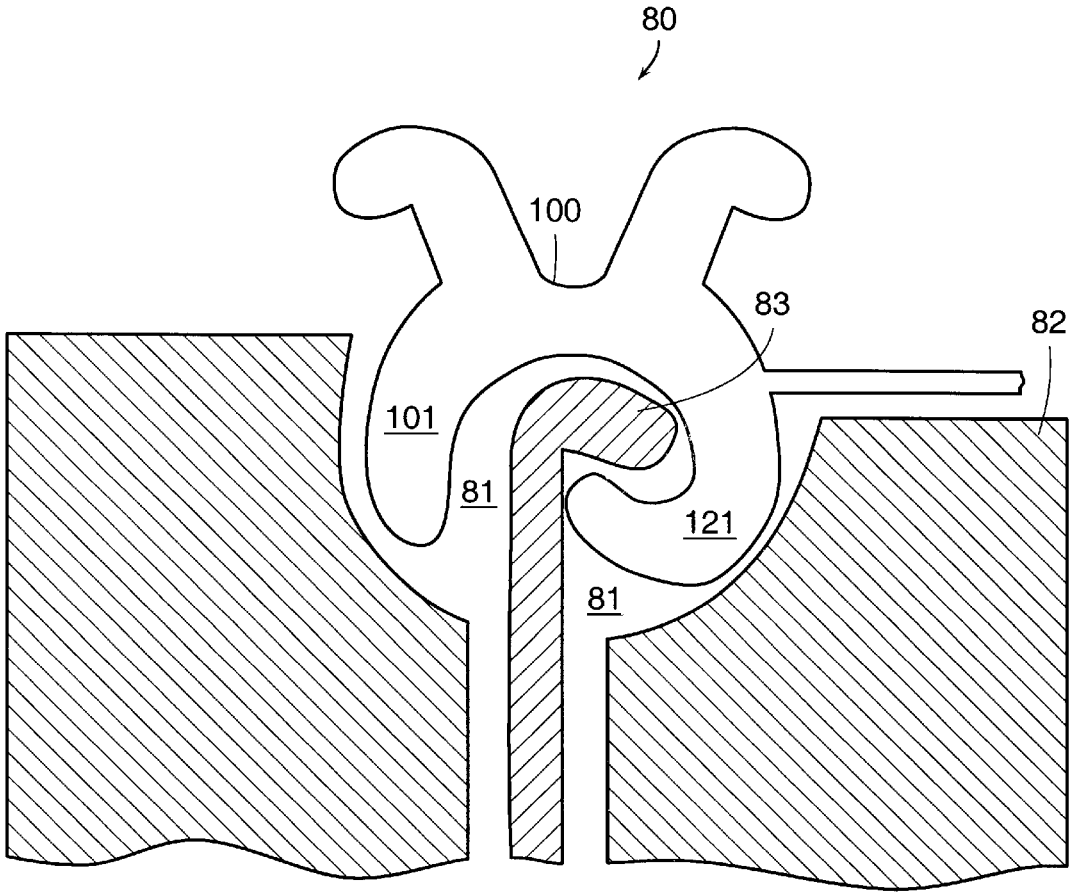
FIG. 8 is a cross section of a sizing device for use in accordance with an embodiment of a method of the present invention.

A further embodiment of the manufacturing method involves extruding the molten profile of the female element through a die which is about 1–1½ to 2 times the size of the final profile, and extruding downward into a water bath. The final shape is formed by a sizing device 80, show in cross section in FIG. 8, that is under the water. The sizing device 80 has multiple parts that can be retracted for thread-up, then moved into place for production. The total vertical length is approximately twelve inches. The parts contacting the molten plastic are metal, and there are slots that allow water to have access to the plastic for cooling. The cross sectional opening 81 within the sizing device 80 is slightly larger than the profile to avoid jamming, yet is capable of pushing and holding the profile in the desired shape. The sizing device 80 is thus analogous to the die, but has larger tolerances to accommodate ordinary variations in profile dimensions. The sizing device 80 has a first portion 82 that places external bounds on the jaws 101 and 121 of the female element 100 to hold them in the closed position while the profile is cooling, and a second portion 83 that acts as a mandril placed within the jaws 101 and 121 to preserve the interior space between the jaws 101 and 121 and permit effective capture of the male element 106 when used to form a seal.

Each profile strip, in various embodiments of the invention, has two distinct parts: a profile portion that interlocks, and a fin portion that is sealed to walls of an enclosure, such as a plastic film for a recloseable bag (see for example, FIG. 1, where the female element 100 has a profile portion 131 and a fin portion 133; the male element 106 has a profile portion 132 and a fin portion 134). These two parts, the profile portion and the fin portion, can be supplied from the same melt source or from two separate extruders. If there is a single melt source, then the thickness of the fin relative to the profile is determined within the die. If there are separate melt sources, it is possible to adjust fin thickness during production by controlling the relative speed of the two extruders, and also it is possible to use different materials for the fin and the profile. The single extruder is simpler and less expensive in capital equipment, but the dual source offers more flexibility of product and controllability of process.

In a further embodiment, a single extruder is used, and the material is high pressure, low density polyethylene. The air gap between the die and the water surface is kept as small as practical, in the order of 1.3 cm. If this gap is made larger, there is more distance over which the fin can draw inward, making it narrower and thicker. This is undesirable because it then requires a narrower gap in the die. This gap is already at a minimum, which is determined by machining limitations.

Similarly, the slider may be die cast as a whole piece or produced in various pieces and assembled. The slider may also be formed with an injection procedure or molded in any suitable fashion.

It should be understood that various changes and modifications to the preferred embodiments described above will also be apparent to those skilled in the art. Modifications can be made without departing from the spirit and scope of the invention and without diminishing its attendant advantages. It is therefore intended that such changes and modifications be covered by the following claims.

What is claimed is:

1. A zipper profile for a fastener assembly comprising:

a male element and a female element, the female element having (i) a pair of jaws movable with respect to one another about a common fulcrum region and (ii) a pair of arms, each of the arms being coupled to a corresponding one of the pair of jaws at the fulcrum region and having an end opposite from the fulcrum region shaped for engagement with a slider;

the jaws having an open position and a closed position and the arms being disposed to cause movement of the jaws between the closed position and the open position when the arms experience displacement about the fulcrum region, such displacement being effectuated by motion of the slider relative to the arms;

the male element being captured when the jaws are in the closed position and released when the jaws are in the open position.

2. A zipper profile according to claim 1, wherein the male element includes an end region for engagement with the slider.

3. A zipper profile according to claim 1, wherein one of the jaws includes a first hook and wherein the male element includes a tip having a second hook, the first and second hooks being engaged when the jaws are closed.

4. A zipper profile according to claim 1, wherein the pair of jaws has a first hook disposed on one and only one of them and the male element has a tip having one and only one second hook disposed thereon, the first and second hooks being engaged when the jaws are closed.

5. A zipper profile according to claim 1, wherein the pair of arms have a pair of adjacent sides and a width and wherein, at the fulcrum region, there is a distance between the adjacent sides that is less than the width.

6. A fastener assembly comprising:

a first profile strip, the first profile strip including a female element having (i) a pair of jaws movable with respect to one another about a common fulcrum region and (ii) a pair of arms, each of the arms being coupled to a corresponding one of the pair of jaws at the fulcrum region and having an end opposite from the fulcrum region shaped for engagement with a slider;

the jaws having an open position and a closed position and the arms being disposed to cause movement of the jaws between the closed position and the open position when the arms experience displacement about the fulcrum region, such displacement being effectuated by motion of the slider relative to the arms;

a second profile strip, the second profile strip having a male element, the male element being captured when the jaws are in the closed position and released when the jaws are in the open position; and a slider, longitudinally movable relative to the strips, for causing the arms to experience displacement about the fulcrum region.

7. A fastener assembly according to claim 6, wherein the first profile strip has a rest region near a longitudinal end thereof wherein one of the arms is truncated, so that when the slider is positioned in the rest region, (i) the slider will not cause the arms to experience displacement about the fulcrum region and (ii) the jaws assume the closed position.

8. A fastener assembly according to claim 7, wherein the male element includes an end region for engagement with the slider and in the rest region the end region is truncated.

9. A fastener assembly according to claim 6, wherein the male element includes an end region for engagement with the slider.

10. A fastener assembly according to claim 9, wherein the slider has a leading end and a trailing end and a cross section including a first channel for capturing the ends of the arms and a second channel for capturing the end region of the male element, the channels experiencing a change in separation along a longitudinal axis, with the separation being greater at the leading end than at the trailing end, so that motion of the slider in the direction of the trailing end pulls the end region of the male element away from the ends of the arms, while the jaws are in an open position, in a manner to cause the male element to be pulled away from the female element.

11. A fastener assembly according to claim 10, wherein the second channel has an entrance and includes a restriction at the entrance near the leading end of the slider, so as to limit angular motion of the tip relative to the end region so as to facilitate engagement of the tip with the first hook as the jaws assume a closed position.

12. A fastener assembly according to claim 10, wherein the slider cross section has a top and a bottom and first and second channels are disposed in the cross section so that they are vertically offset from one another.

13. A fastener assembly according to claim 10, wherein the separation remains substantially constant in a first region near the trailing end and the separation increases progressively in a second region near the leading end, such separation being relatively greater at the leading end.

14. A fastener assembly according to claim 10, wherein the first channel decreases in width progressively in a first region of the slider near the trailing end, such width being relatively greater at the trailing end, and remains at a substantially constant width in a second region of the slider near the leading end.

15. A fastener assembly according to any of claims 6–10 wherein one of the jaws includes a first hook and wherein the male element includes a tip having a second hook, the first and second hooks being engaged when the jaws are closed.

16. A fastener assembly according to claim 6, wherein the pair of arms have a pair of adjacent sides and a width and wherein, at the fulcrum region, there is a distance between the adjacent sides that is less than the width.

17. A zipper profile for a fastener assembly comprising:

a male element and a female element, the female element having (i) a pair of jaws movable with respect to one another about a common fulcrum region and (ii) a pair of arms, each of the arms being coupled to a corresponding one of the pair of jaws at the fulcrum region and having an end opposite from the fulcrum region, the end including means for engaging with a slider;

the jaws having an open position and a closed position and the arms being disposed to cause movement of the jaws between the closed position and the open position when the arms experience displacement about the fulcrum region, such displacement being effectuated by motion of the slider relative to the arms;

the male element being captured when the jaws are in the closed position and released when the jaws are in the open position.

18. A zipper profile according to claim 17, wherein the male element includes an end region, the end region including means for engaging with the slider.

19. A zipper profile according to claim 17, wherein the pair of jaws has a first hook disposed on one and only one of them and the male element has a tip having one and only one second hook disposed thereon, the first and second hooks being engaged when the jaws are closed.

20. A zipper profile according to claim 17, wherein the pair of arms have a pair of adjacent sides and a width and wherein, at the fulcrum region, there is a distance between the adjacent sides that is less than the width.

21. A resealable bag comprising:

a first profile strip, the first profile strip including a female element having (i) a pair of jaws movable with respect to one another about a common fulcrum region and (ii) a pair of arms, each of the arms being coupled to a corresponding one of the pair of jaws at the fulcrum region and having an end opposite from the fulcrum region shaped for engagement with a slider;

the jaws having an open position and a closed position and the arms being disposed to cause movement of the jaws between the closed position and the open position when the arms experience displacement about the fulcrum region, such displacement being effectuated by motion of the slider relative to the arms;

a second profile strip, the second profile strip having a male element, the male element being captured when the jaws are in the closed position and released when the jaws are in the open position;

a first side panel depending from the female element; and a second side panel being depending from the male element.

22. A resealable bag according to claim 21, further comprising:

a slider, longitudinally movable relative to the strips, for causing the arms to experience displacement about the fulcrum region.

23. A resealable bag according to claim 22, wherein the first profile strip has a rest region near a longitudinal end thereof wherein on of the arms is truncated, so that when the slider is positioned in the rest region, (i) the slider will not cause the arms to experience displacement about the fulcrum region and (ii) the jaws assume the closed position.

24. A resealable bag according to claim 22, wherein the male element includes an end region for engagement with the slider.

25. A resealable bag according to claim 22, wherein the slider has a leading end and a trailing end and a cross section including a first channel for capturing the ends of the arms and a second channel for capturing the end region of the male element, the channels experiencing a change in separation along a longitudinal axis, with the separation being greater at the leading end than at the trailing end, so that motion of the slider in the direction of the trailing end pulls the end region of the male element away from the ends of the arms, while the jaws are in an open position, in a manner to cause the male element to be pulled away from the female element.

26. A resealable bag according to claim 25, wherein one of the jaws includes a first hook and wherein the male element includes a tip having a second hook, the hooks being engaged when the jaws are closed.

27. A resealable bag according to claim 26, wherein the second channel has an entrance and includes a restriction at the entrance near the leading end of the slider, so as to limit angular motion of the tip relative to the end region so as to facilitate engagement of the tip with the first hook as the jaws assume a closed position.

28. A resealable bag according to claim 25, wherein the slider cross section has a top and a bottom and the first and second channels are disposed in the cross section so that they are vertically offset from one another.

29. A resealable bag according to claim 25, wherein the separation remains constant in a first region near the trailing end and the separation increases progressively in a second region near the leading end.

30. A resealable bag according to claim 29, wherein the first channel decreases progressively in width in the first region and remains at a substantially constant width in the second region.

31. A reasealable bag according to claim 21, wherein the pair of arms have a pair of adjacent sides and a width and wherein, at the fulcrum region, there is a distance between the adjacent sides that is less than the width.

32. A method of removably fastening a first side panel to a second side panel, wherein:

(i) the first side panel has a first profile strip, the first profile strip including a female element having a pair of jaws having an open position and a closed position, the jaws being actuatable by longitudinal motion of a slider; and (ii) the second side panel has a second profile strip, the second profile strip having a male element;

the method comprising:

providing a slider longitudinally movable relative to the strips, wherein the slider has a cross section, the cross section having a top and a bottom and first and second channels disposed in the cross section so that they are vertically offset from one another, and wherein a portion of the first profile strip is disposed in the first channel and a portion of the second profile strip is disposed in the second channel;

using a first longitudinal region of the slider to maintain the jaws in an open position while causing the male element to be displaced into the jaws;

using a second longitudinal region of the slider to cause the jaws to move from an open position to a closed position; and sliding the slider longitudinally along the strips so that they transition into a state wherein, along at least a portion of the strips, the male element is within the jaws and the jaws are closed.

* * * * *

UNITED STATES PATENT AND TRADEMARK OFFICE

CERTIFICATE OF CORRECTION

PATENT NO. : 6,439,771 B1
DATED : August 27, 2002
INVENTOR(S) : F. John Herrington It is certified that error appears in the above-identified patent and that said Letters Patent is hereby corrected as shown below:

Column 10,
Line 56, delete “being” after “panel”
Line 65, change “on” to -- one --

Signed and Sealed this

Fifteenth Day of October, 2002

*Attest:*

*Attesting Officer*

JAMES E. ROGAN
*Director of the United States Patent and Trademark Office*